US008869434B2

(12) United States Patent
Peraro et al.

(10) Patent No.: US 8,869,434 B2
(45) Date of Patent: Oct. 28, 2014

(54) BOOT FOR SPORTING ACTIVITIES

(75) Inventors: Massimo Peraro, Arre (IT); Giuseppe Rosato, Casella d'Asolo (IT); Lorenzo Rosato, Casella d'Asolo (IT)

(73) Assignee: La Rocca di Rosato L. & C. S.N.C., Asolo (TV) (IT)

( * ) Notice: Subject to any disclaimer, the term of this patent is extended or adjusted under 35 U.S.C. 154(b) by 1723 days.

(21) Appl. No.: 12/094,943

(22) PCT Filed: Dec. 13, 2006

(86) PCT No.: PCT/EP2006/069692

§ 371 (c)(1),
(2), (4) Date: Sep. 5, 2008

(87) PCT Pub. No.: WO2007/068729

PCT Pub. Date: Jun. 21, 2007

(65) Prior Publication Data

US 2009/0049715 A1 Feb. 26, 2009

(30) Foreign Application Priority Data

Dec. 13, 2005 (IT) ..... VI05A0333

(51) Int. Cl.
*A43B 3/26* (2006.01)
*A43B 5/04* (2006.01)
*A43B 5/16* (2006.01)

(52) U.S. Cl.
CPC ..... *A43B 5/0427* (2013.01); *A43B 5/1608* (2013.01); *A43B 3/26* (2013.01)
USPC ..... 36/97; 36/117.3

(58) Field of Classification Search
USPC ..... 36/97, 103, 112, 116, 115, 36/117.1–117.3, 31, 117.4, 117.7
See application file for complete search history.

(56) References Cited

U.S. PATENT DOCUMENTS 2,497,175 A * 2/1950 Mantos ..... 36/97
4,178,925 A * 12/1979 Hirt ..... 602/11
4,333,192 A * 6/1982 Stockli et al. ..... 12/142 E
4,959,914 A * 10/1990 Hilgarth ..... 36/117.3
4,998,358 A * 3/1991 Girardelli ..... 36/117.3
5,645,288 A * 7/1997 Lu ..... 280/11.26
5,678,833 A * 10/1997 Olson et al. ..... 280/11.224
5,682,687 A * 11/1997 Arai ..... 36/97

(Continued)

FOREIGN PATENT DOCUMENTS

CA 2152358 A1 * 7/1994
WO WO9441350 A1 * 7/1994

*Primary Examiner* — Ted Kavanaugh
(74) *Attorney, Agent, or Firm* — IP Strategies

(57) ABSTRACT

The invention is a boot (1; 100) comprising a shaped shell (2; 101) including a rear portion (3; 102) that surrounds the heel (T) of the user's foot (P) and a front portion (4; 103) that develops mainly along a longitudinal axis (X) and surrounds the distal region (D) and the top (S) of the foot (P) and is 5 telescopically associated with the rear portion (3; 102) to which it is connected through fixing means (5). One of the front (4; 103) and rear portions (3; 102) is provided with a plurality of first through holes (6; 104) defining longitudinal axes (Z1; Z'1) that are parallel to each other and separated by a predefined distance (L1; L'1) and are selectively arranged coaxially to second through 10 holes (7; 105) made in the other one of the rear (3; 102) and front portions (4; 103), where they house the fixing means (5), in such a way as to vary the length of the shaped shell (2; 101) by discrete values.

24 Claims, 8 Drawing Sheets

(56) References Cited

U.S. PATENT DOCUMENTS 5,729,912 A * 3/1998 Gutkowski et al. ..... 36/97
5,746,016 A * 5/1998 Freisinger et al. ..... 36/117.1
5,836,592 A * 11/1998 Chang ..... 280/11.26
6,276,697 B1 * 8/2001 Lin ..... 280/11.26
6,402,163 B1 * 6/2002 Pratt ..... 280/11.26
6,863,285 B2 * 3/2005 Gonthier ..... 280/14.22
7,055,268 B2 * 6/2006 Ha ..... 36/97
7,144,018 B1 * 12/2006 Chen ..... 280/11.221

* cited by examiner

BOOT FOR SPORTING ACTIVITIES

FIELD OF THE INVENTION

The invention described herein concerns a boot for sporting activities, particularly suited to be used by children or young people for sporting activities like skiing, skating, alpinism and the like.

BACKGROUND OF THE INVENTION

It is known that for practising winter sports, like Alpine skiing, both as a competitive and professional activity and as a leisure time activity, a particular type of boot must be worn.

This boot comprises a shaped shell currently made, in most cases, of a plastic material, that develops mainly along a horizontal longitudinal axis, but for a short section also along another substantially vertical longitudinal axis.

The shaped shell is provided with a flat sole that, especially at the level of the heel and toe, is shaped in such a way as to adapt to the ski bindings.

The shaped shell is also equipped with a pair of buckles, used to close the boot tightly once the user has put it on, applied to the area of the outer surface that rests against the top of the foot.

In some known models, the boot comprises also a leg, associated with the shaped shell by means of pins, which surrounds and protects part of the user's leg.

A specific type of boots currently available on the market offers the possibility to vary the length of the shaped shell and has been designed especially for children or young persons that are still growing up, as well as for hire shoos that must be rather flexible as regards the available boot sizes.

In this regard, patents EP 1 428 443 and FR 2 358 117 are referred to as examples of prior art.

The boots with adjustable length of known type comprise a shaped shell that includes a rear portion, suited to surround at least the heel of the user's foot, and a front portion, known to anyone skilled in the art as "lower shell", that develops mainly along a longitudinal axis.

The front portion is suitable for surrounding the distal region and the top of the foot and is telescopically associated with the rear portion, to which it is permanently connected through fixing means, usually screws.

The fixing means are inserted in threaded through holes, made coaxially in both the above mentioned portions starting from the lower surface, that is, the surface that is in contact with the ski or the ground, belonging to the rear portion.

Therefore, the front portion partially overlaps the rear portion, to which it is telescopically coupled.

The boot length can be varied with the aid of sliding means comprising projections that, depending on the case, are arranged on the upper surface of the rear portion or on the lower surface of the front portion.

These projections, for example pins, are slidingly arranged in corresponding grooves obtained on the lower surface of the front portion or on the upper surface of the rear portion, respectively.

In this way, according to the known art, to modify the length of the boot, which may be necessary, for example, due to the growth of the foot, the user loosens the fixing means, which locked the mutually sliding portions of the shaped shell in the previous position, partially extracts the front portion from the rear portion and locks them in the new position using the fixing means again.

However, the boots carried out according to the known art just described have some drawbacks.

The main drawback of the boots of known type lies in that the operation for adjusting the length of the shaped shell is rather complex and long to carry out. In fact, it often happens that the user has to repeat more than once the operations necessary to handle the fixing means and to modify the mutual position of the front and rear portions before achieving the optimal length of the shaped shell, suited to the size of the user's foot.

This is due to the fact that the sliding means allow the shaped shell to be adjusted only in a continuous way, that is, increasing or reducing its length by an indefinite and imprecise value.

Consequently, the user carries out the adjusting operations without the aid of any reference element, appreciatively, which inevitably prolongs the time required to achieve the desired length.

A further drawback derives from the fact that the connection between the front portion and the rear portion is not optimal and leaves a slack between them, due to the position in which the fixing means are generally applied.

Consequently, the conditions of use of the boot on the one hand are uncomfortable and troublesome for the user and on the other may also affect the soundness of the boot over time.

BRIEF SUMMARY OF THE INVENTION

The present invention intends to overcome the drawbacks posed by the prior art that have just been described.

In particular, the main aim of the invention is to propose a boot for sporting activities whose length can be adjusted more efficiently compared to the boots carried out according to the known art.

In other words, it is the aim of the invention to reduce, compared to the equivalent known art, the complexity of the manoeuvres that the user must carry out to vary the length of a boot for sports by increasing or reducing it according to the size of the foot that must wear the boot.

Within the scope of the above mentioned aim, the invention intends to allow the user to adjust the boot more precisely compared to the known equivalent boots.

It is a further aim of the invention to enable the adjusting operation to be carried out more quickly than allowed by the current state of the art.

It is another, yet not the least aim of the invention to propose a boot for sporting activities that, when worn, is structurally more stable than the boots of known type.

The aims described above have been achieved through the construction of a boot that, according to the main claim, comprises a shaped shell including a rear portion, suited to surround at least the heel of the user's foot, and a front portion that develops mainly along a longitudinal axis, suited to surround at least the distal region of said foot and telescopically associated with said rear portion to which it is connected through fixing means, the boot being characterized in that one of said front and rear portions is provided with a plurality of first through holes defining longitudinal axes that are parallel to each other and separated by a predefined distance, suited to be selectively arranged coaxially to one or more second through holes, made in the other rear or front portion, in which they receive said fixing means, in such a way as to vary the length of said shaped shell by discrete values.

Advantageously, the invention allows the user to vary the length of a boot for sports more effectively than in the known art.

In fact, the presence of suitable reference elements accessible to the user, in this case the through holes made in the front and rear portions of the shaped shell, facilitates, compared to the known art, the operations necessary to adjust the length of the shaped shell, making them immediately precise, definite, less complex and quicker.

According to the invention, it will no longer be necessary to try more than once the mutual position of the front and rear portions before finding the position that is most suited to the size of the foot that is going to wear the boot, as it happens, on the contrary, with the boots currently available on the market.

It will be sufficient to modify the mutual position of the portions just described by a precise length, given by the distance between the longitudinal axes of the first through holes made in one, front or rear, of the portions of the shaped shell.

This distance is properly calculated in the design and construction stage of the boot that is the subject of the invention, and corresponds to the difference in length usually existing between boots of different, consecutive size.

According to a preferred embodiment of the invention, the boot claimed herein makes it possible to obtain three different and consecutive sizes, with a maximum variation of 2.4 cm in the length of the shaped shell.

Still to advantage, the boot that is the subject of the invention has greater structural stability than equivalent boots of known type.

This is due to the new and special application of the fixing means that constrain the front and rear portions on two opposite sides and not on one side only, as it happens in the boots carried out according to the prior art.

BRIEF DESCRIPTION OF THE DRAWINGS

The aims and advantages described above, as well as others illustrated below, will be highlighted in greater detail in the description of preferred embodiments of the invention, given indicatively with reference to the enclosed drawings, wherein.

DETAILED DESCRIPTION OF THE INVENTION

Figure 1:
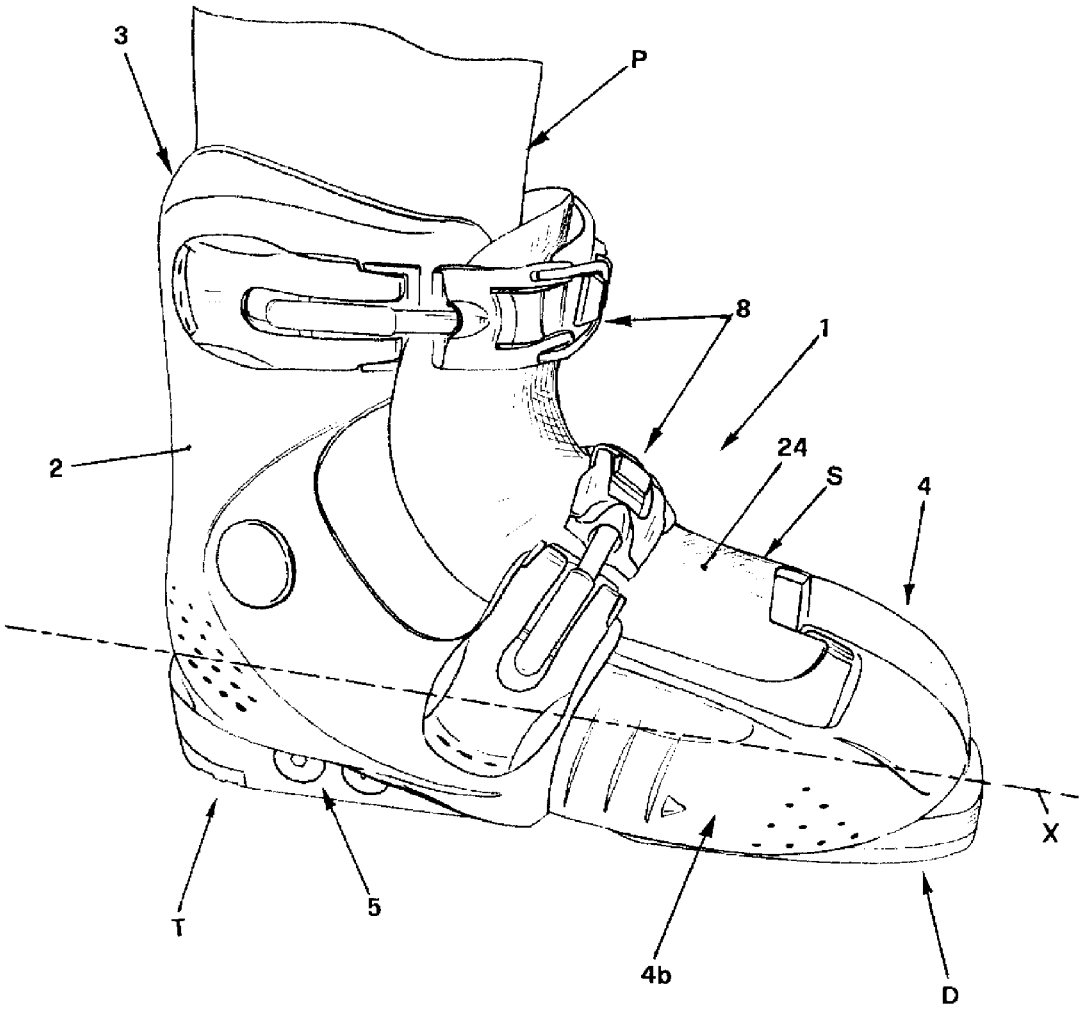
FIG. 1 is an axonometric view of the boot that is the subject of the invention.

The boot for sporting activities that is the subject of the invention is shown in FIG. 1, where it is indicated as a whole by 1, while worn on the foot P of a person.

In particular, the boot 1 is suited to be used for skiing by children or young persons who are still growing up.

It can be observed that the boot 1 comprises a shaped shell 2 including a rear portion 3 that surrounds the heel T of the user's foot P, and a front portion 4 that develops mainly along a longitudinal axis X, surrounds the distal region D and the top S of the foot P and is telescopically associated with the rear portion 3 to which it is connected through fixing means indicated as a whole by 5.

Figure 2:
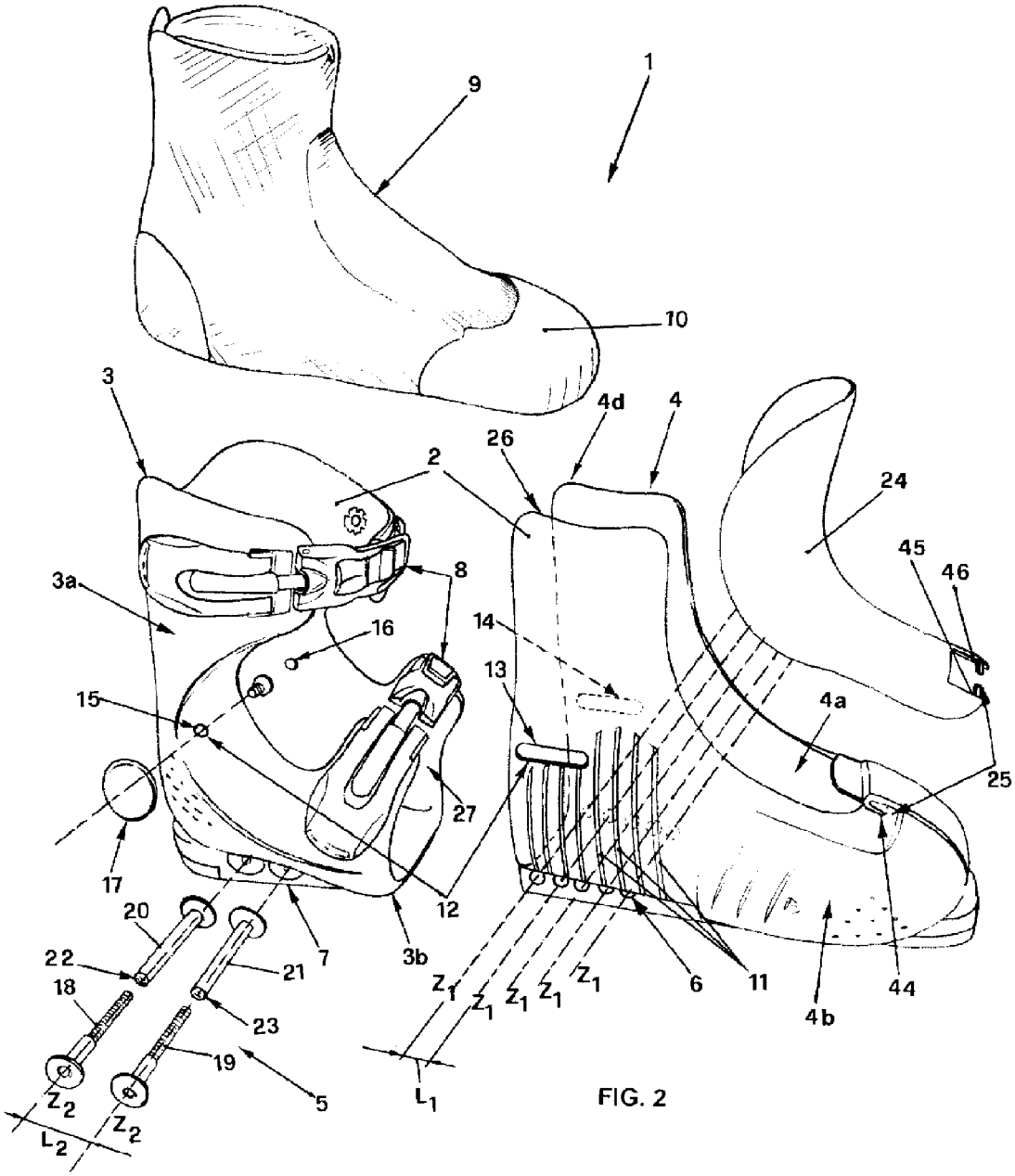
FIG. 2 is an exploded view of the boot shown in FIG. 1.

According to the invention, the front portion 4 has a plurality of first through holes 6 defining longitudinal axes $Z_1$ parallel to one another and separated by a predefined distance $L_1$, suited to be selectively arranged coaxially to a series of second through holes 7 made in the rear portion 3 and visible in FIG. 2, where they receive the fixing means 5, in order to vary the length of the shaped shell 2 by discrete values.

Each one of the longitudinal axes $Z_1$ defined by the first through holes 6 is substantially orthogonal to the longitudinal axis X defined by the front portion 4. In this case, the front portion 4 is provided with five first through holes 6, while the rear portion 3 is provided with two second through holes 7 whose longitudinal axes $Z_2$ are separated by a distance $L_2$ that, as illustrated in FIG. 2, is equal to twice the distance $L_1$ between the longitudinal axes $Z_1$.

FIGS. 1 and 2 show coupling means, indicated as a whole by 8 and of the type known per se to any technician skilled in the art, suited to close the boot 1 for use.

The boot 1 also comprises an inner lining 9, positioned inside the shaped shell 2, provided with a cap 10 made of an elastic material that allows the inner lining 9 to adapt to the inner wall 4*a* of the front portion 4 during insertion.

Preferably, but not necessarily, the elastic material is a synthetic yarn, also known under the trade name of "lycra".

FIGS. 1 and 2 show that, preferably but without any limitation, the side surface 4*b* of the front portion 4 is provided on the outside with protruding ribs 11 that ensure greater tightness against the infiltration of water.

The boot 1 also comprises sliding means, indicated as a whole by 12, associated with the shaped shell 2, which maintain the front portion 4 and the rear portion 3 connected to each other during the operations necessary to adjust the length of the shaped shell 2.

The sliding means 12 comprise:

- one pair of slots 13, 14 opposing each other, made on the side surface 4*b* of the front portion 4;
- one pair of through holes 15, 16 coaxial to each other, made in the side surface 3*a* of the rear portion 3, each one of which is in communication with one of the slots 13, 14 compared to which it is less developed longitudinally;
- connection means, indicated as a whole by 17 and of the type known per se, like for example screws and nut screws, slidingly inserted in the slots 13, 14 and in the through holes 15, 16.

Each of the through holes 15, 16 preferably features a circular profile.

The fixing means 5 comprise:

- two screws 18, 19 inserted in two of the first through holes 6 made in the front portion 4 and in the second through holes 7 made in the rear portion 3;
- two tubular bodies 20, 21, each provided with a nut screw 22, 23 in which one of the screws 18, 19 engages, inserted in the two first through holes 6 mentioned above of the front portion 4 and in the two second through holes 7 of the rear portion 3, on the opposite side and coaxially to the screws 18, 19.

The boot 1 also comprises a shaped tab 24, visible also in FIG. 3, arranged at the level of the top S of the foot P, slidingly associated with the upper surface 4*c* of the front portion 4 to which it is connected through constraining means, indicated as a whole by 25, which will be described here below.

The front portion 4 comprises reference means, not represented to simplify the figures, like for example notches, arranged at the level of the first through holes 6, accessible to the user for the definition of the size.

FIG. 2 shows that the front portion 4 is hollow and has a shaped opening 26 in its rear area 4*d*.

Also the rear portion 3 is hollow and in its front area 3*b* there is an inlet opening 27 through which the front portion 4 is partially inserted in the rear portion 3 itself.

According to the preferred embodiment of the invention described herein, the predefined distance $L_1$ between the longitudinal axes $Z_1$ of the first through holes 6 is equal to the difference in length, as an absolute value, between two different sizes of the shaped shell 2.

Therefore, the boot 1 carried out according to the invention makes it possible to obtain, in a precise and practical manner, three consecutive sizes and can be used for several years by the same person, be it a child or a young person whose physical structure is continuously growing, or by different persons with similar bodily structure.

As will be explained below with reference to FIGS. 7 to 9, to vary the length of the shaped shell 2 of the boot 1 it is necessary to move the front portion 4 with respect to the rear portion 3 by a length equal to $L_1$, each time arranging two of the first through holes 6 coaxial to the two second through holes 7.

The first through holes 6 are obtained on the bottom 4*e* of the front portion 4, while the second through holes 7 are obtained on the bottom 3*c* of the rear portion 3.

Figure 4:
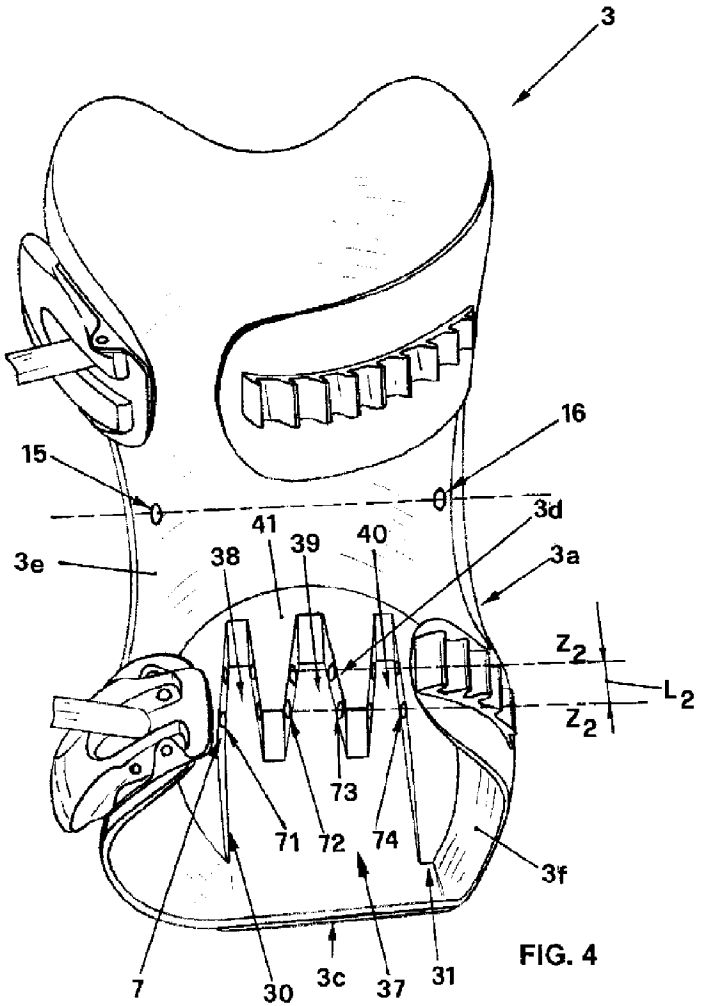
FIG. 4 shows a second detail of FIG. 2.
Figure 3:
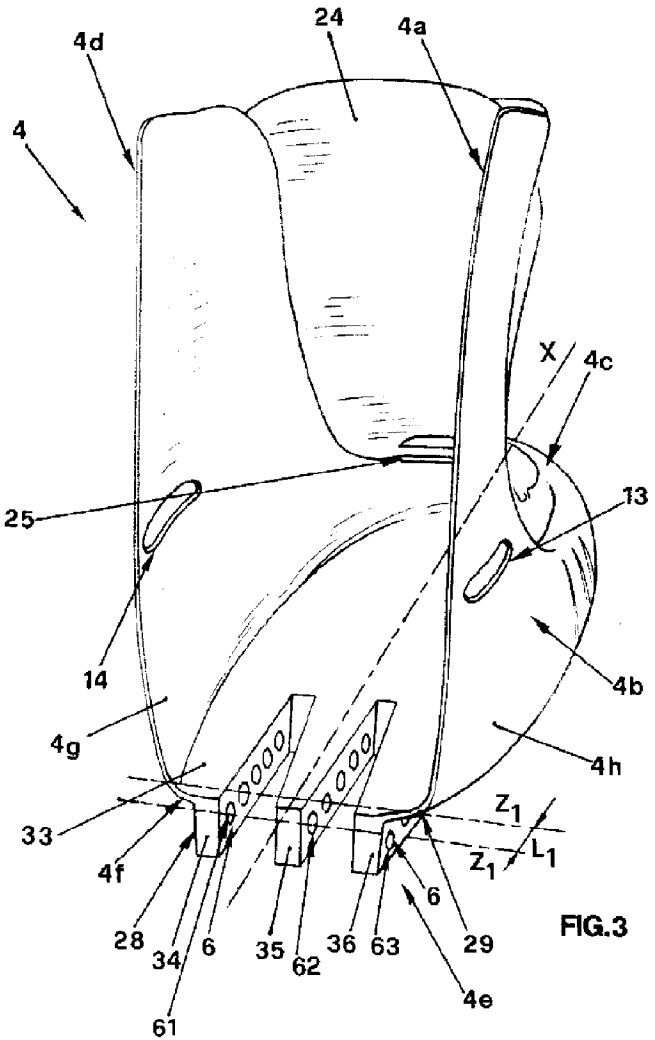
FIG. 3 shows a first detail of FIG. 2.

FIGS. 3 and 4 show that the bottom 4*e* of the front portion 4 has, on its outer wall 4*f* and at the level of the shaped opening 26, one pair of shaped recesses 28, 29 that develop mainly longitudinally, arranged symmetrically to the longitudinal axis X and slidingly coupled to one pair of shaped projections 30, 31 protruding from the inner wall 3*d* of the bottom 3*c* of the rear portion 3.

The shaped recesses 28, 29 are obtained starting from the side walls 4*g*, 4*h* facing each other of the front portion 4, towards the centre of the outer wall 4*f* of the bottom 4*e*.

The shaped projections 30, 31 are internally connected to the side walls 3*e*, 3*f* facing each other of the rear portion 3.

The shaped recesses 28, 29 define in the bottom 4*e* a flat base 33 where the first through holes 6 are made.

In detail, the flat base 33 is constituted in this case by three distinct and separate longitudinal arms 34, 35, 36 that divide each of the first through holes 6 into three first coaxial through openings 61, 62, 63 with closed profile.

FIG. 4 shows that the shaped projections 30, 31 are separated from each other by a lowered area 37 that slidingly houses the base 33.

The longitudinal arms 34, 35, 36 are housed inside three corresponding longitudinal channels 38, 39, 40, obtained at the level of the rear area 41 of the bottom 3*c* of the rear portion 3, defining a comb-like coupling between the arms 34, 35, 36 and the channels 38, 39, 40.

The longitudinal channels 38, 39, 40 divide each of the second through holes 7 in four second coaxial through openings 71, 72, 73, 74 with closed profile.

In FIGS. 3 and 4 it can be observed that the longitudinal arms 34, 35, 36 and the longitudinal channels 38, 39, 40 respectively define for the flat base 33 and the rear area 41 a substantially W-shaped profile, according to a cross section transverse to the longitudinal axis X.

In other embodiments of the invention, not illustrated herein, the flat base of the front portion may consist of a different number of longitudinal arms.

The number of longitudinal channels of the rear area of the bottom of the rear portion will vary accordingly.

Figure 6:
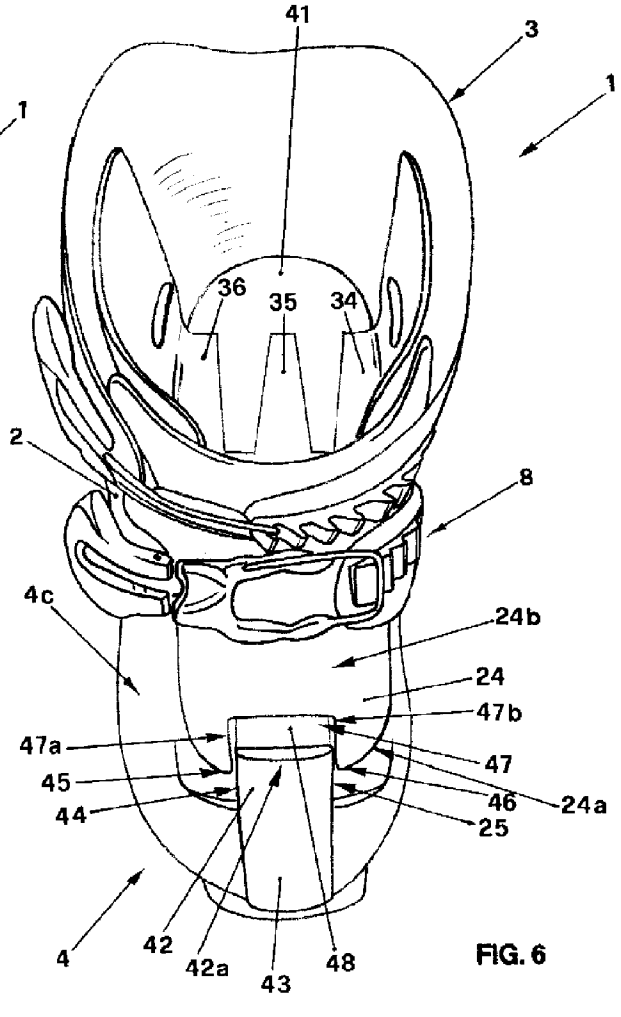
FIGS. 5 and 6 show a plan view of the detail of FIG. 2 in two different operating conditions.
Figure 5:
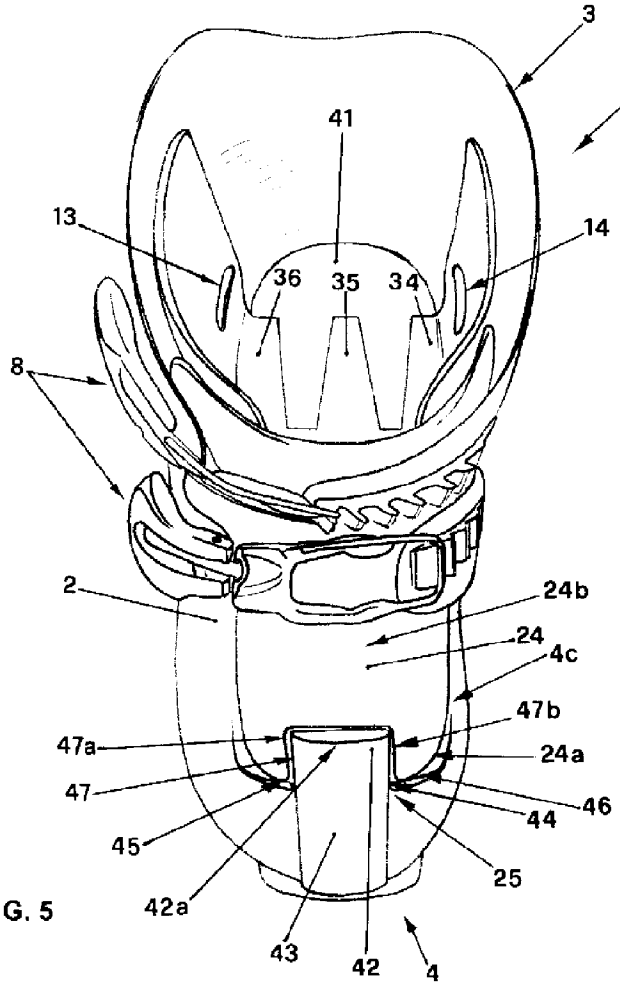

FIGS. 5 and 6 show in detail the coupling of the shaped tab 24 to the front portion 4, which exploits, as already explained, the constraining means 25, which comprise:

- a sheet-like projection 42, protruding towards the rear portion 3 starting from a raised section 43 of the upper surface 4*c* of the front portion 4, with which it defines a slit 44 that is better visible in FIG. 2;
- one pair of shaped teeth 45, 46 facing each other, projecting from the opposite sides 47*a*, 47*b* of a recess 47 obtained at one end 24*a* of the shaped tab 24 and where the sheet-like projection 42 is arranged, said shaped teeth being slidingly coupled inside the slit 44.

The sheet-like projection 42 has on its upper wall 42*a* a lowered section 48 that serves to position the upper wall 24*b* of the shaped tab 24 so that it is coplanar with the upper wall 42*a* of the sheet-like projection 42.

Indicatively, the recess 47 in plan view has a substantially rectangular profile.

The slit 44 is delimited on the top by the sheet-like projection 42, on the bottom by the front portion 4 and laterally by transverse walls, not indicated, against which the shaped teeth 45, 46 force to prevent the shaped tab 24 from sliding.

Figure 10:
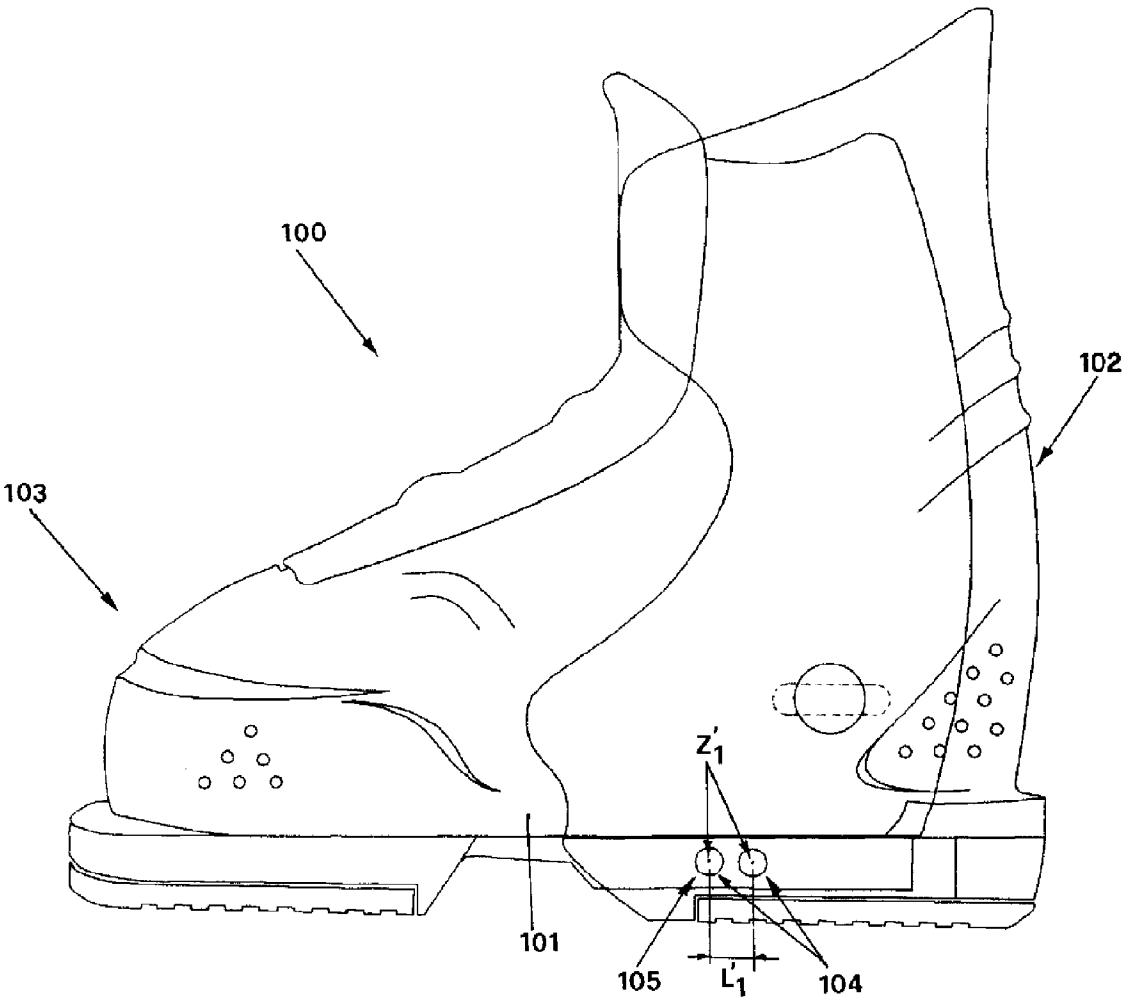
FIG. 10 shows a construction variant of FIG. 2.

FIG. 10 shows a construction variant of the invention, wherein the boot, indicated as a whole by 100, is differentiated from the one described above due to the fact that the front portion 103 has two first through holes 104 and the rear portion 102 has only one second through hole 105.

With the boot 100 it is obviously possible to vary the length of the shaped shell 101 by one size only.

In this case the fixing means, not represented herein to simplify the figures, will be constituted by a single screw and by a single tubular body inserted in one of the first through holes 104 and in the single second through hole 105.

The distance $L'_1$ between the longitudinal axes $Z'_1$ of the first through holes 104 is equal to the distance $L_1$ present between the axes $Z_1$ of the first through holes 6 of the boot 1.

It is understood, however, that in other embodiments of the invention, not represented in the attached drawings, the distance between the longitudinal axes of the first through holes may have any length, provided that it is equal to a multiple of the above mentioned distance $L'_1$.

There may be further construction variants, not illustrated, where a single second through hole in the rear portion is combined with a number of first through holes in the front portion that is greater than two, to vary the length of the shaped shell by various sizes.

From a practical point of view the user, for example a young person or a child, wears the boot 1 during the winter to practice a sport like Alpine skiing.

Figure 7:
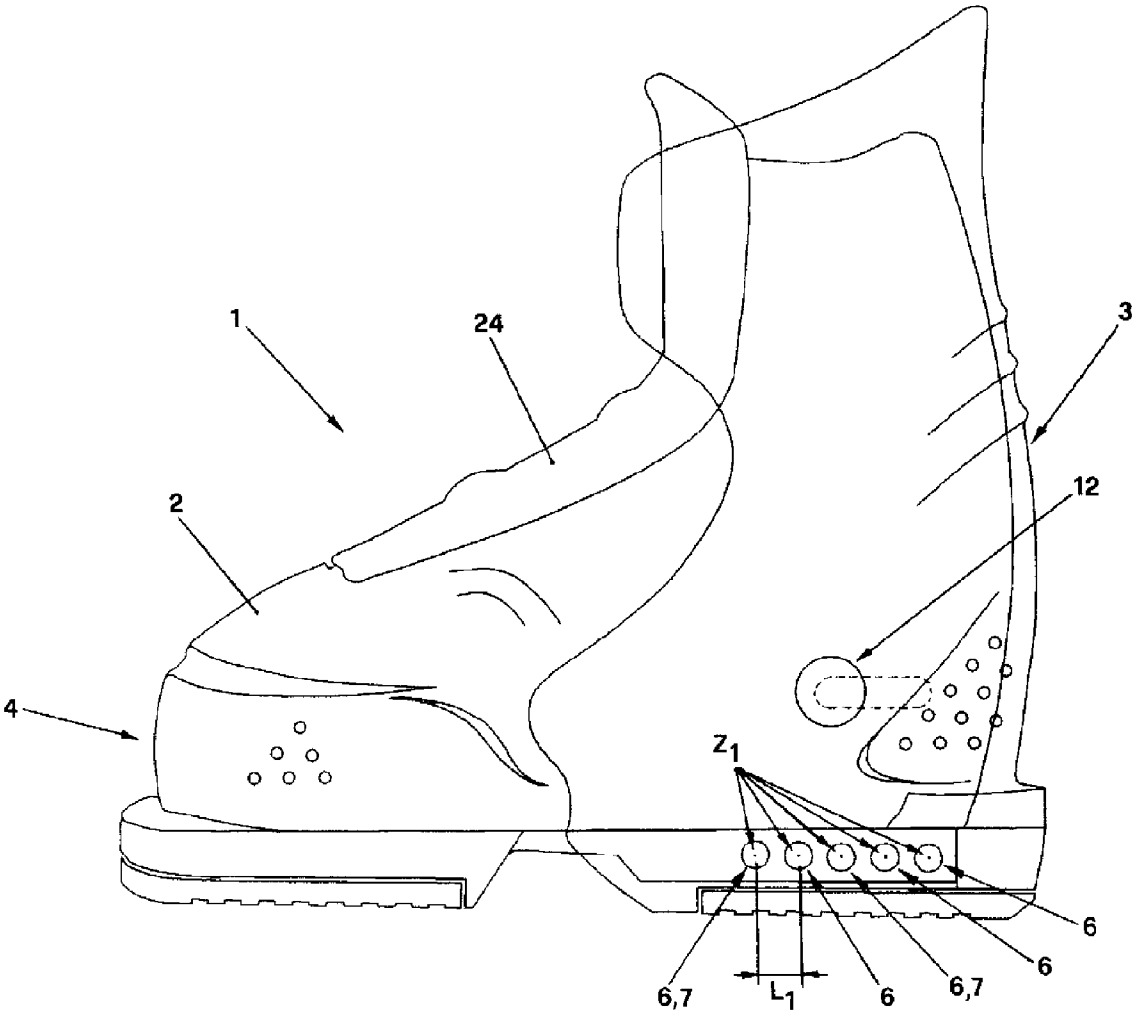
FIGS. 7 to 9 show side views of the boot of FIG. 1 in different operating conditions.

In these conditions, the front portion 4 of the shaped shell 2 is partially inserted in the front portion 3 and the fixing means 5 are arranged in the configuration shown in FIG. 7, which is this specific case corresponds to the minimum length of the shaped shell 2.

More precisely, the fixing means 5 are inserted in the first and in the third of the first through holes 6 and in both the second through holes 7.

Furthermore, in these conditions the flat base 33 of the front portion 4 is completely coupled to the lowered area 37 of the rear portion 3, with the longitudinal arms 34, 35, 36 contained in the corresponding longitudinal channels 38, 39, 40.

When the user, due to his/her growth, for example in the following winter, feels that the boot 1 is narrow, and thus no more suited to his/her foot, he/she or someone else removes the fixing means 5 from the first and second through holes 6, 7, releasing only partially the front portion 4 from the rear portion 3.

In fact, in this operating condition the rear portion 3 and the front portion 4 remain connected to each other, though not in a stable manner, thanks to the presence of the sliding means 12.

Successively, the user extracts the front portion 4 from the rear portion 3 for a section corresponding exactly to the distance $L_1$ between the longitudinal axes $Z_1$ of the first through holes 6.

Figure 8:
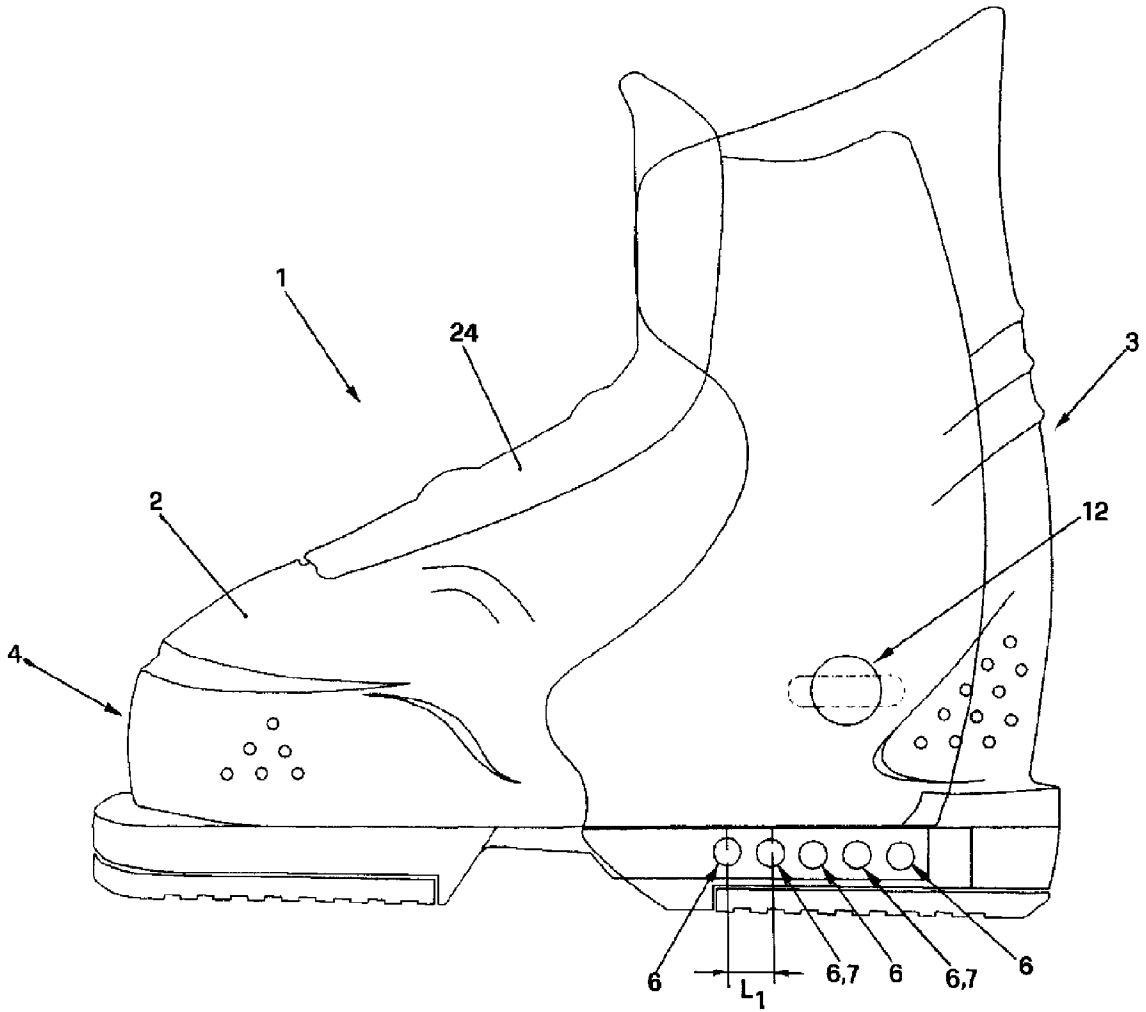

The boot 1 thus takes on the intermediate configuration shown in FIG. 8, where the second and the fourth of the first through holes 6 are coaxial with the corresponding second through holes 7.

In this way, the length of the shaped shell 2 increases by a given value that is not indefinite and approximate as in the known art, since $L_1$ corresponds to the difference in size between two boots having consecutive length values, and the boot 1 is thus adapted to suit the new physical structure of the user's foot.

In this stage, the operation needed to arrange the front portion 4 in the desired position with respect to the rear portion 3 is advantageously facilitated thanks to the presence of the reference means indicating the various sizes.

The user then applies the fixing means 5 to the first through holes 6 and to the second coaxial through holes 7 just indicated, permanently connecting the front portion 4 and the rear portion 3 in the new mutual position.

The application on opposite sides of the fixing means 5 to the front portion 4 and rear portion 3 makes it possible to obtain greater structural stability of the boot 1 during normal use compared to the boots of known type.

If the user feels that the boot 1 is still narrow after the adjustment just described, or if it is immediately evident that the length variation of the shaped shell 2 must correspond to more than one size, a further adjusting operation exactly like the previous one must be carried out.

Figure 9:
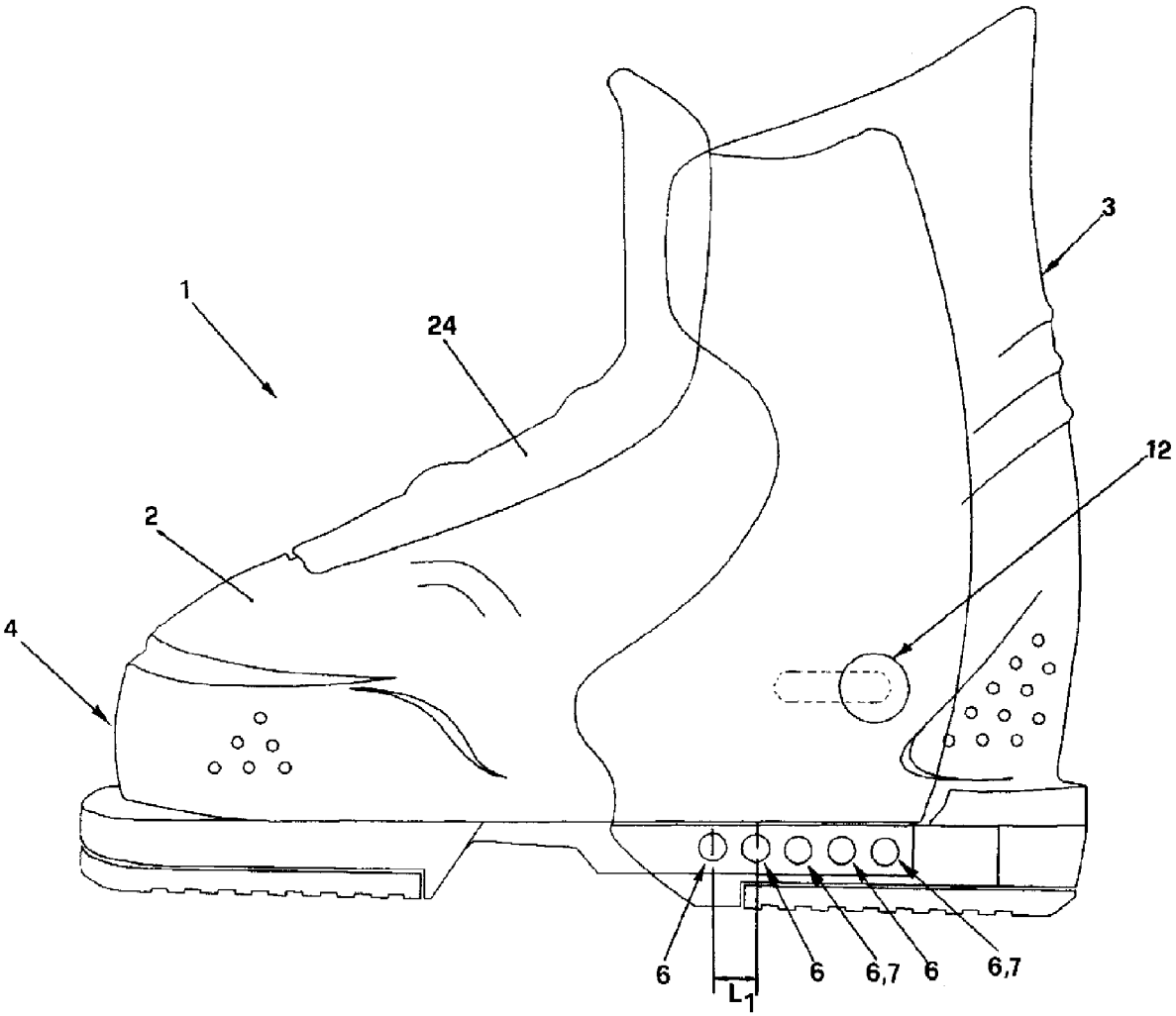

The user moves the front portion 4 forward with respect to the rear portion 3, so that the third and the fifth of the first through holes 6 is coaxial with the corresponding second through holes 7 and, once reached the desired position, applies the fixing means 5, as shown in FIG. 9, which represents the condition of maximum length of the shaped shell 2.

The adjustment of the length of the shaped shell can be carried out even proceeding in the opposite way, when, for example, the boot must be used by another person, younger than or with a physical structure less developed than that of the person who has just used it or who usually wears it.

In this case, the length variation will consist in introducing a greater section of the rear portion inside the front portion, in any case a section corresponding to the required length and to the distance between the longitudinal axes of the first through holes.

The user can adapt the boot 1 even better to his/her foot, once he/she has worn it, by means of the shaped tab 24 that, as already explained, slides in the slit 44.

The adjustment of the length of the shaped shell 101 of the boot 100 corresponds exactly to the adjustment described for the boot 1, with the only difference that in this case only one of the first through holes 104 is coaxial to the second through hole 105 in the various conditions of use.

On the strength of the above considerations, it is therefore clear that the boot for sporting activities of the invention achieves the objects and offers the advantages described above.

In the construction phase, modifications may be made to the boot of the invention consisting, for example, in a different shape of the portions that make up the shaped shell.

It must be specified that the inventive concept that underlies the invention can be applied to those boots that are generally worn by users that are young and still growing up.

Furthermore, the fixing means may be of a type different from the one described herein, which does not affect the advantages offered by the present patent.

Furthermore, in other embodiments of the invention the series of first through holes may be made in the rear portion, while the front portion may be provided with one or more second through holes.

In the cases where the technical characteristics illustrated in the claims are followed by references, these have been added only with the aim to facilitate the comprehension of the claims themselves and therefore said references do not have any limiting effect on the degree of protection to be granted to each element they identify only by way of example.

All the variations described and referred to, but not shown in the attached drawings, must be considered protected by the present patent, since they fall within the scope of the inventive concept expressed by the following claims.

The invention claimed is:

1. Boot, comprising:

a shaped shell including a rear portion that is suited to surround at least the heel of a wearer's foot, and a front portion that develops mainly along a longitudinal axis, is suited to surround at least a distal region of said foot, and is telescopically associated with said rear portion, to which it is connected through fixing means, wherein a bottom of said front portion presents first essentially parallel longitudinal arms having corresponding first longitudinal channels defined by interspaces between said first longitudinal arms, wherein the first arms and first channels extend in a plane that is essentially parallel to the longitudinal axis, wherein a bottom of said rear portion presents second essentially parallel longitudinal arms having corresponding second longitudinal channels defined by interspaces between said second longitudinal arms, wherein the second arms and second channels extend in a plane that is essentially parallel to the longitudinal axis, wherein said first longitudinal arms match said second longitudinal channels and said second longitudinal arms match said first longitudinal channels, defining an interleaved coupling among said arms and said channels, essentially in a single longitudinally-extending plane forming at least a portion of a smooth inner surface of the bottoms of the front and rear portions, and wherein said first and second longitudinal arms are provided with a plurality of respective first and second through-holes, traversing said longitudinal arms and defining longitudinal axes that are parallel to each other and separated by a predefined distance, suited to be selectively arranged coaxially to pair one or more first through-holes with corresponding second through-holes, wherein said first and second through-holes are suited to receive said fixing means, in such a way as to vary a length of said shaped shell by discrete values.

2. Boot according to claim 1, wherein each one of said longitudinal axes defined by said first through holes is substantially orthogonal to said longitudinal axis defined by said front portion.

3. Boot according to claim 1, wherein said predefined distance between said longitudinal axes of said first through holes is equal to a difference in length, as an absolute value, between two different lengths of said shaped shell.

4. Boot according to claim 3, wherein said sizes are consecutive.

5. Boot according to claim 1, wherein said front portion is hollow and has a shaped opening in its rear area.

6. Boot according to claim 5, wherein said rear portion is hollow and has a front area having an inlet opening through which said front portion is partially inserted in said rear portion.

7. Boot according to claim 1, wherein said bottom of said front portion has on its outer wall and at a level of said shaped opening one pair of shaped recesses that develop mainly longitudinally, arranged symmetrically to said longitudinal axis and slidingly coupled to one pair of shaped projections protruding from an inner wall of said bottom of said rear portion.

8. Boot according to claim 7, wherein said shaped recesses are obtained starting from side walls facing each other of said front portion towards a centre of said outer wall of said bottom.

9. Boot according to claim 7, wherein said shaped projections are internally connected to side walls facing each other of said rear portion.

10. Boot according to claim 9, wherein said shaped projections are divided from each other by a lowered area that slidingly houses a flat base defined in the bottom of the front portion by the shaped recesses.

11. Boot according to claim 9, wherein said longitudinal arms and said longitudinal channels respectively define for a flat base defined in the bottom of the front portion by the shaped recesses and said rear area a substantially W-shaped profile, according to a cross section transverse to said longitudinal axis.

12. Boot according to claim 1, wherein said means comprise:

at least one screw inserted in one of said first through holes obtained in said front portion and in one of said second through holes obtained in said rear portion;

at least one tubular body, provided with a nut in which said screw engages, inserted in one of said first through holes of said front portion and in one of said second through holes of said rear portion, on the opposite side and coaxially to said screw.

13. Boot according to claim 1, wherein it comprises a shaped tab suited to be arranged at the level of the top of said foot, slidingly associated with an upper surface of said front portion to which it is connected through constraining means.

14. Boot according to claim 13, wherein said constraining means comprise:

a projection, protruding towards the rear portion starting from a raised section of said upper surface of said front portion, with which it defines a slit;

one pair of shaped teeth facing each other, projecting from opposite sides of a recess obtained at one end of said shaped tab and where said projection is arranged, slidingly coupled inside said slit.

15. Boot according to claim 14, wherein said projection has on its upper wall a lowered section that serves to position the upper wall of said shaped tab so that it is coplanar with said upper wall of said projection.

16. Boot according to claim 14, wherein said recess in plan view has a substantially rectangular profile.

17. Boot according to claim 14, wherein said slit is delimited on a top by said projection, on a bottom by said front portion and laterally by transverse walls against which said shaped teeth force to prevent the shaped tab from sliding.

18. Boot according to claim 1, wherein it comprises an inner lining, positioned inside said shaped shell, provided with a cap made of an elastic material and allowing said inner lining to adapt to an inner wall of said front portion during insertion.

19. Boot according to claim 18, wherein said elastic material is a synthetic yarn.

20. Boot according to claim 1, wherein a side surface of said front portion is provided on an outside with protruding ribs that ensure greater tightness against the infiltration of water.

21. Boot according to claim 1, wherein it comprises sliding means associated with said shaped shell, suited to maintain said front portion and said rear portion connected to each other during the operations necessary to vary said length of said shaped shell.

22. Boot according to claim 21, wherein said sliding means comprise:

one pair of slots opposing each other, made on a side surface of said front portion;

one pair of through holes coaxial to each other, made in the side surface of said rear portion, each one of which is in communication with one of said slots compared to which it is less developed longitudinally;

connection means, slidingly inserted in said slots and in said through holes.

23. Boot according to claim 22, wherein each of said through holes has a circular profile.

24. Boot according to claim 1, wherein said front portion comprises reference means arranged at a level of said first through holes accessible to the user for defining the size.

* * * * *